United States Patent [19]

Brown et al.

[11] 4,318,973

[45] Mar. 9, 1982

[54] OVERCOATED INORGANIC LAYERED PHOTORESPONSIVE DEVICE AND PROCESS OF USE

[75] Inventors: George A. Brown, Penfield; Lloyd A. Relyea, Webster; Merlin E. Scharfe; Heinz W. Pinsler, both of Penfield, all of N.Y.

[73] Assignee: Xerox Corporation, Stamford, Conn.

[21] Appl. No.: 239,239

[22] Filed: Mar. 2, 1981

Related U.S. Application Data

[62] Division of Ser. No. 127,176, Mar. 5, 1980, Pat. No. 4,287,279.

[51] Int. Cl.[3] ..... G03G 13/22

[52] U.S. Cl. ..... 430/31; 430/902

[58] Field of Search ..... 430/31, 57, 58, 60, 430/63, 902

[56] References Cited

U.S. PATENT DOCUMENTS

| | | | |
|---|---|---|---|
| 3,041,166 | 6/1962 | Bardeen | 430/60 X |
| 3,355,289 | 11/1967 | Hall et al. | 430/57 |
| 3,635,705 | 1/1972 | Ciuffini | 430/57 |
| 3,655,377 | 4/1972 | Sechak | 430/57 |
| 4,050,935 | 9/1977 | Limburg et al. | 430/59 |
| 4,202,937 | 5/1980 | Fukuda et al. | 430/58 |
| 4,254,199 | 3/1981 | Tutihasi | 430/58 |
| 4,275,132 | 6/1981 | Chu et al. | 430/31 |

FOREIGN PATENT DOCUMENTS

| | | | |
|---|---|---|---|
| 2061655 | 6/1972 | Fed. Rep. of Germany | 430/57 |
| 7604387 | 4/1976 | Netherlands | 430/57 |

*Primary Examiner*—Roland E. Martin, Jr.
*Attorney, Agent, or Firm*—E. O. Palazzo

[57] ABSTRACT

This invention is generally directed to inorganic overcoated photoresponsive devices comprised of a substrate, a layer of hole injecting material capable of injecting holes into a layer on its surface, this layer being comprised of trigonal selenium, a hole transport layer in operative contact with the hole injecting layer, this layer being comprised of a halogen doped selenium arsenic alloy, wherein the percentage by weight of selenium present is from about 99.5 percent to about 99.9 percent, the percentage by weight of arsenic present is from about 0.1 percent to about 0.5 percent, and the halogen is present in an amount of from about 10 parts per million, to about 200 parts per million; a charge generating layer overcoated on the hole transport layer, comprised of an inorganic photoconductive material; and a layer of insulating organic resin overlaying the charge generating layer. This device is useful in an electrophotographic imaging system using in a preferred embodiment a double charging sequence, that is, negative charging, followed by positive charging.

4 Claims, 4 Drawing Figures

OVERCOATED INORGANIC LAYERED PHOTORESPONSIVE DEVICE AND PROCESS OF USE

This is a division, of application, Ser. No. 127,176, filed Mar. 5, 1980, now U.S. Pat. No. 4,287,279.

BACKGROUND OF THE INVENTION

This invention generally directed to a photoresponsive imaging device, and more specifically to layered photoresponsive devices, and the use of such devices in electrophotographic imaging systems.

Electrophotographic copying, and more specifically xerography as described in U.S. Pat. No. 2,297,691, involves the development of an electrostatic latent image on the surface of a photosensitive plate or photoreceptor, which is comprised of a conductive substrate containing on its surface a layer of photoconductive insulating material. In some instances there is included a thin barrier layer between the substrate and the photoconductive layer, such as aluminium oxide, to prevent charge injection from the substrate to the photoconductive layer upon charging of the plate surface.

In one known method a latent image is formed on the photoreceptor surface by first charging the plate in the dark, such as by exposing it to a cloud of corona ions, and imaging by exposing the plate to a light and shadow image, for the purpose of selectively discharging the photoreceptor, whereby a latent image corresponding to the shadow areas is formed. This latent electrostatic image is then developed by contacting the plate surface with a developing material such as toner, which will adhere to the latent image due to electrostatic attraction. The toned image can then be transferred to a substrate such as paper, followed by subsequent fusing of the toner into the paper thereby forming a permanent copy.

The imaging surface of the photoreceptor is then cleaned by any of several known methods, including charging, the purpose of the cleaning generally being to remove any residual toner and/or the electrostatic latent image. Also the electrostatic latent image can be used in a number of other ways such as for example, electrostatic scanning systems may be employed to read the latent image or the latent image can be transferred to other materials by TESI techniques and stored. The developed image can also be read or permanently affixed to the photoconductor when the imaging layer is not to be reused.

Numerous types of photoreceptors can be used in the above-described method, and are well-known, such photoreceptors including for example, organic materials like polyvinylcarbazole, inorganic materials such as selenium and selenium alloys, and mixtures thereof. Photoreceptors are also known wherein the charge carrier generation and charge carrier transport functions are accomplished by discrete contiguous layers. Also known are photoreceptors which include an overcoating layer of an electrically insulating polymeric material, and in conjunction with this overcoated type photoreceptor there have been proposed a number of imaging methods, such as the method described, for example, in the text by R. M. Schaffert on Electrophotography published by Focal Press Limited, London, 1975. In one process there is used a non-ambipolar photoconductor wherein charge carriers are injected from the substrate electrode into the photoconductor surface.

In such a system in order to obtain high quality images the injecting electrode must satisfy the requirements that it injects charge carriers efficiently and uniformly into the photoconductor.

While imaging systems and devices have been described in copending applications, similar to the device of the present invention such devices are primarily directed to layered structures comprised mostly of organic substances, for example the transport layer can be organic, and different types of injecting electrodes are used. While these devices function adequately, there continues to be a need for improved photoreceptor devices, and more specifically layered inorganic photoreceptor devices which have excellent injecting properties, and therefore can be used in electrophotographic systems for the purpose of obtaining images of high quality over a long period of time.

SUMMARY OF THE INVENTION

It is an object of this invention to provide a layered photoresponsive device which contains a specific hole injecting material.

An additional object of the present invention is to provide an electrophotographic device which has a prolonged life as compared to some known photoreceptors, such as amorphous selenium, and further which device allows the production of latent images of improved resolution.

It is another object of the present invention to provide an inorganic photoresponsive device containing a specific transport layer, and a specific generating layer.

These and other objects of the present invention are accomplished by providing a layered inorganic photoresponsive or photosensitive device, which can be used in various imaging systems, such as electrophotographic systems employing double charging, this device being comprised of a substrate or supporting base, containing on its surface a layer of hole injecting material comprised of trigonal selenium, a hole transport layer in operative contact with the hole injecting layer, the transport layer being comprised of a halogen doped selenium arsenic alloy, wherein the percentage by weight of selenium present is from about 99.5 percent to about 99.9 percent, the percentage by weight of arsenic present is from about 0.1 percent to 0.5 percent; a charge generating material overcoated on the transport layer, this material being comprised of inorganic photoconductive substances, and as a protective layer, a layer of insulating organic resin overlaying the charge generating layer. About 10 parts per million to about 200 parts per million of halogen material is present, in the transport layer.

In one preferred embodiment of the present invention this substrate is a conductive material, such as aluminum, the hole injecting layer is trigonal selenium, the hole transport layer is a halogen doped selenium arsenic alloy, wherein the amount of selenium present by weight is from about 99.5 to 99.9 percent, the amount of arsenic by weight is from about 0.1 percent to 0.5 percent, and the halogen material is present in an amount of from about 50 parts per million, to 100 parts per million, the charge generating layer is an alloy of selenium tellurium, and the overcoating layer is a polyester, or polyurethane material.

In one embodiment the trigonal selenium hole injecting material can be prepared by vapor deposition in a vacuum coater of selenium onto a supporting substrate. The transport layer is then overcoated on the trigonal selenium injecting layer, followed by coating of the generating layer on the transport layer, and optionally an organic insulating resin layer is overcoated on the generating layer, as indicated herein. Generally a strong bond is formed between the hole injecting layer and the substrate, and the hole injecting layer and the transport layer. Subsequent deposition of the transport and generation layers is conducted in a vacuum chamber, i.e., a 24 inch vacuum coater, well known in the art. Heating of the substrate during the deposition is preferably accomplished using a temperature controlled mandrel in contact with the rear of the substrate. This mode of heating (in distinction for instance to glow discharge heating) minimizes additional oxide formations on the etched aluminum surface and allows better control of the substrate temperature during the entire photoconductor evaporation process. Depending on the type of photoreceptor device desired the process conditions can vary accordingly, as indicated herein.

The substrate, which is comprised in one embodiment of a flexible high purity aluminum sheet usually has to be treated in order that initiation of the crystallization of high purity selenium will occur. Thus, for example, the aluminum sheet which is highly polished is abraded with Scotch Brite until a matte finish is obtained, followed by etching with an Efferal solution. In another embodiment, when a rigid cylindrical drum is used as the substrate, the aluminum drum is first subjected to a mild caustic etch using a known mixture of trisodium phosphate, sodium carbonate and water. Additionally, prior to use, a further etching with a Efferal solution can be employed.

The trigonal selenium injecting layer which is in operative contact with the substrate such as an aluminum sheet is prepared by evaporating a weighed amount of high purity selenium from a separate boat. The weighed amount will be dependent on the specific vacuum coater configuration but is calibrated to yield the desired thickness, as indicated hereinafter of trigonal selenium on the substrate. The substrate temperature during this evaporation is ideally maintained at about 95° to about 120° C. The selenium evaporation rate is adjusted in order that the rate of condensation of vapors on the substrate is not greater than the rate of conversion of amorphous to crystalline selenium at the substrate temperature, since this insures that the crystalline injector trigonal selenium layer is formed simultaneously upon contact. If an amorphous layer is allowed to deposit followed by slow conversion to the crystalline form there may result a serious reduction in hole injection efficiency and/or reduction in the adhesion of the hole injecting layer to the substrate.

The transport layer which is comprised of a halogen doped selenium arsenic alloy is evaporated by current state-to-the-art techniques, in order to result in layer of the desired thickness, as described hereinafter, for example up to about 60 microns. The amount of alloy present in the evaporation boats will depend on the specific coater configuration, and other process variables but is calibrated to yield the desired transport layer thickness. Chamber pressure during operation is of the order of less than $4\times10^{-5}$ Torr. Evaporation can be completed over a period of time which ranges from about 15 to about 25 minutes during which the temperature of the crucible containing the molten alloy increases from 25° C. to about 300° C. Other times vs. temperatures outside these ranges are also useable as will be understood by those skilled in the art. During deposition of the transport layer it is desirable that the substrate temperature be maintained in the range of from about 60° C. to about 80° C.

The generating layer which is comprised in one embodiment of an alloy of selenium-tellurium, 75 percent to 80 percent selenium, and 20 percent to 25 percent of tellurium, is prepared by grinding the selenium tellurium alloy, and preparing pellets from the ground material so as to result in a layer of the desired thickness as indicated herein, for example, up to 5 microns. The pellets are evaporated from crucibles using a time/temperature crucible program designed to minimize the fractionation of the alloy during evaporation. In this manner the concentration of tellurium across the generating layer can be maintained reasonably close to the composition of the pellets (a "flat" tellurium profile). A typical crucible program for this step will form a 0.6 micron generating layer in about 12 to about 15 minutes during which time the crucible temperature is increased from 25° C. to 385° C.

In some instances deviation of the surface tellurium content above and below 25 percent will result in higher and lower photoresponsive sensitivity and corresponding higher or lower dark decay rates.

The above device comprised of a substrate, overcoated with an injecting layer of trigonal selenium, which in turn is overcoated with the transport layer indicated, the transport layer containing a generating layer thereover can then be overcoated with an insulating organic resin layer. Typically, a layer having a thickness of from about 5 microns to about 25 microns of a polyurethane resin is deposited by solution spray coating, although other resins and other techniques of resin deposition may be used.

In one preferred method of operation the above described layered photoreceptor device is charged a first time with electrostatic charges of a negative charge polarity, subsequently charged a second time with electrostatic charges of a positive polarity for the purpose of substantially neutralizing the charges residing on the electrically insulating surface of the member, and subsequently exposing the member to an imagewise pattern of activating electromagnetic radiation thereby forming an electrostatic latent image. This image can then be developed to form a visible image which is transferred to a receiving member. The imaging member may be subsequently reused to form additional reproductions after the erase and cleaning steps have been accomplished.

BRIEF DESCRIPTION OF THE DRAWINGS

For a better understanding of the present invention and further features thereof reference is made to the following detailed description of various preferred embodiments wherein.

DESCRIPTION OF THE PREFERRED EMBODIMENTS

Figure 1:
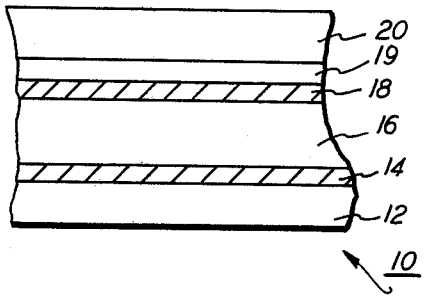
FIG. 1 is a partially schematic cross-sectional view of the layered photoreceptor device of the present invention.

Illustrated in FIG. 1 is a photoreceptor device generally designated 10, comprising a substrate layer 12, overcoated with a hole injecting layer 14, comprised of trigonal selenium which in turn is overcoated with a transport layer 16, which is comprised of a halogen doped selenium arsenic alloy as defined herein, which layer in turn is overcoated with a generating layer 18, comprised of inorganic photoconductive substances, such as alloys of selenium tellurium, and as an optional layer a hole trapping layer 19, and finally an overcoating layer 20 of an insulating organic resin such as a polyurethane or polyester.

Substrate layer 12 may comprise any suitable material having the requisite mechanical properties, thus for example, this substrate can be comprised of a layer of an organic or inorganic material having a conductive surface layer thereon, or conductive materials such as aluminum, nickel, and the like. One of the primary purposes of the substrate layer is for support, and systems can be envisioned where the substrate might be dispensed with entirely. The thickness of the substrate layer, which in some instances can be an optional layer, is dependent upon many factors including economic considerations, and design of the machine within which the photoresponsive device is to be used. Thus this layer may be of substantial thickness for example up to 200 mils, or of minimum thickness, that is approximately 5 mils, provided there are no adverse effects on the system. Generally, however, the thickness of this layer ranges from about 5 mils to about 100 mils. The substrate can be flexible, or rigid, and may have many different configurations, such as for example, a plate, a cylindrical drum, a scroll, an endless flexible belt, and the like.

The hole injecting layer 14, which is comprised of trigonal selenium, injects charge carriers or holes into layer 16 under the influence of an electrical field. The injected charge carriers should be of the same polarity as the mobile carriers transported by the transport layer, layer 16, during the imaging process. The thickness of the trigonal selenium layer ranges from about 0.5 microns to about 10 microns and preferably from about 1 micron to about 5 microns. The minimum and maximum thickness of this layer is generally determined by the electrical properties desired, and it is not intended to be limited to the specific thickness disclosed. Also the charge carrier (hole) injecting layer, and the charge carrier transport layer require a particular work function relationship in order that the hole injection from the former into the latter can be effectively accomplished, while minimizing the injection of the opposite sign carriers.

The transport layer 16 is comprised of a halogen doped selenium arsenic alloy, wherein the percent of selenium present ranges from about 99.5 percent to about 99.9 percent, and the percentage of arsenic present ranges from about 0.1 percent to about 0.5 percent. The amount of halogen, chlorine, fluorine, iodine, or bromine present ranges from about 10 parts per million, to about 200 parts per million, with the preferred range being from about 50 parts per million, to about 100 parts per million. The preferred halogen is chlorine. Thus, for example, while other alloys have cyclic residual potentials of 200 volts or more after 1,000 copy cycles in an electrophotographic system, with the alloy of the present invention residuals of zero (0) to 25 volts result after the same number of cycles. This layer generally ranges in thickness from about 5 to about 60 microns and preferably from about 25 microns to about 50 microns. Other inorganic photoconductors can be used for this layer including for example amorphous selenium, various other selenium alloys including selenium tellurium, arsenic sulfur selenium, selenium doped with various halogen materials, and other suitable panchromatic inorganic substances.

The inorganic photoconductive generating layer 18 in one embodiment is comprised of a selenium tellurium alloy, with the percentage of selenium being from about 70 percent to about 90 percent, and the percentage of tellurium being from about 10 percent to about 30 percent. Preferably about 75 percent of selenium, and 25 percent of tellurium is present in the generating layer 18. This layer ranges in thickness of from about 0.1 micron to about 5 microns, and preferably from 0.2 to about 1 micron. The generating layer generally is of a thickness which is sufficient to absorb at least 90% or more of the incident radiation which is directed upon it in the imagewise exposure step.

The electrically insulating overcoating layer 20 is generally from about 5 to about 25 microns in thickness, and preferably from about 12 to about 18 microns in thickness. Generally this layer provides a protective function, in that the photoconductive material surface is kept from being contacted by toner and ozone which is generated during the imaging cycles, and from physical damage from scratching and the like. The overcoating layer also prevents corona charges from penetrating through it into the charge generating layer 18 or from being injected into it by the latter. Preferably therefore, layer 20 comprises materials having high resistance to charge carrier injection and low carrier mobilities. The minimum thickness of this layer is determined by the function the layer must provide, whereas the maximum thickness is determined by mechanical considerations and the resolution capability desired for the photoresponsive device. Typical suitable overcoating materials include polyethylenes, polycarbonates, polystyrenes, polyesters, polyurethanes, and the like, with polyurethanes commercially available from Mobil Corporation or Kansai Paint Company, and polyesters commercially available from Goodyear Chemical Company being the preferred overcoating layer.

The formation of the insulating layer over the charge generating layer may be accomplished by any one of several methods known in the art such as spraying, dipping, roll coating and the like, by which a solution of one layer material is applied. By evaporation of the solvent, a hard resistive layer is left. Non-solution methods may also be used.

Figure 2A:
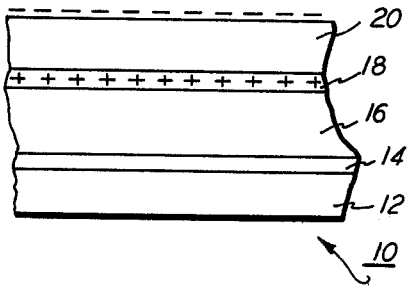
FIGS. 2A to 2C illustrate the imaging steps employed.
Figure 2B:
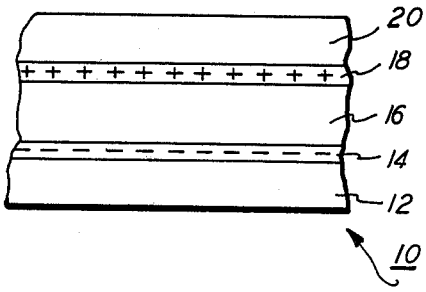
Figure 2C:
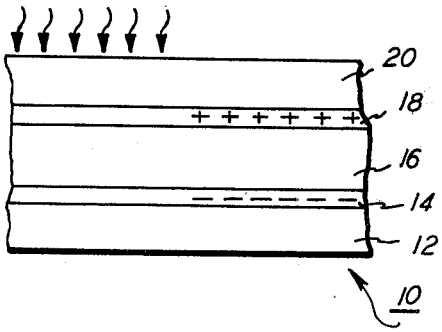

The operation of the member of the present invention is illustrated in FIGS. 2A–2C. In this illustrative explanation the initial charging step is carried out with negative polarity. As noted previously, the method is not limited to this embodiment. Moreover, the description of the method will be given in conjunction with a proposed theoretical mechanism, by which the method is thought to be operative, in order to better aid those skilled in the art to understand and practice the invention. It should be noted, however, that the method has been proved to be operable and highly effective through actual experimentation and any inaccuracy in the proposed theoretical mechanism of operation is not to be construed as being limiting of the invention.

Referring to FIG. 2A, there is seen the condition of the photoreceptor after it has been electrically charged negatively a first time, uniformly across its surface in the absence of illumination, by any suitable electrostatic charging apparatus such as a corotron. The negative charges reside on the surface of electrically insulating layer 20. As a consequence of the charging an electrical field is established across the photoreceptor, and as a consequence of the electrical field and the work function relationship between layers 14 and 16, holes are injected from the charge carrier injecting layer into the charge carrier transport layer. The holes injected into the charge carrier transport layer are transported through the layer, enter into the charge carrier generating layer 18 and travel through the latter until they reach the interface between the charge carrier generating layer 18 and the electrically insulating layer 20, where they become trapped. The charges thus trapped at the interface establish an electrical field across the electrically insulating layer 20. Thus, it is seen that in the embodiment where negative charging is carried out in the first charging step, charge carrier injecting layer 14 and charge carrier transport layer 16 must comprise materials which will allow injection of holes from the former into the latter. Also, the charge carrier transport layer 16 and the charge carrier generating layer 18 allow injection of holes from the former into the latter, and allow the holes to reach the interface between layer 18 and electrically insulating layer 20.

Subsequently, the member is charged a second time, again in the absence of illumination, with a polarity opposite to that used in the first charging step in order to substantially neutralize the charges residing on the surface of the member. In this illustrative instance, the second charging of the member is with positive polarity. After the second charging step the surface of the photoreceptor should be substantially free of electrical charges. The substantially neutralized surface is created by selecting a charging voltage, such that the same number of positive charges are deposited as negative charges previously deposited. By "substantially neutralized" within the context of this invention is meant that the voltage across the photoreceptor member, upon illumination of the photoreceptor, is substantially zero.

FIG. 2B illustrates the condition of the photoreceptor after the second charging step. In this illustration no charges are shown on the surface of the member. The positive charges residing at the interface of layers 18 and 20 as a result of the first charging step remain trapped at the interface, at the end of the second charging step. However, there is now a uniform layer of negative charges located at the interface between layers 14 and 16.

Therefore the net result of the second charging step is to establish a uniform electrical field across the charge carrier transport and charge carrier generating layers. To achieve this result it is critical that the negative charges be located at the interface between charge carrier injecting layer 14 and charge carrier transport layer 16, and be prevented from entering into and being transported through the transport layer. For this reason it is mandatory to utilize a charge carrier transport material which will allow injection of only one species of charge carrier, namely holes in this illustrative instance. This is especially necessary when a charge carrier transport material is used which is capable of transporting both species of charge carriers.

Subsequently, reference FIG. 2C, the member is exposed to an imagewise pattern of electromagnetic radiation to which the charge carrier generating material comprising layer 18 is responsive. The exposure of the member may be effected through the electrically insulating overcoating. As a result of the imagewise exposure an electrostatic latent image is formed in the photoreceptor. This is because hole electron pairs are generated in the light-struck areas of the charge carrier generating layer. The lightgenerated holes are injected into the charge carrier transport layer and travel through it to be neutralized by the negative charges located at the interface between layers 14 and 16. The light-generated electrons neutralize the positive charges trapped at the interface between layers 18 and 20. In the areas of the member which did not receive any illumination, the positive charges remain in their original position. Thus, there continues to be an electrical field across the charge carrier transport and charge carrier generating layers in areas which do not receive any illumination, whereas the electrical field across the same layers in the areas which receive illumination is discharged to some low level (FIG. 2C).

The electrostatic latent image formed in the member may be developed to form a visible image by any of the well-known xerographic development techniques, for example, cascade, magnetic brush, liquid development and the like. The visible image is typically transferred to a receiver member by any conventional transfer technique and affixed thereto. While it is preferable to develop the electrostatic latent image with marking material the image may be used in a host of other ways such as, for example, "reading" the latent image with an electrostatic scanning system.

When the photoreceptor device of the present invention is to be reused to make additional reproduction, as is the case in a recyclable xerographic apparatus, any residual charge remaining on the photoreceptor after the visible image has been transferred to a receiver member typically is removed therefrom prior to each repetition of the cycle as is any residual toner material remaining after the transfer step. Generally, the residual charge can be removed from the photoreceptor by ionizing the air above the electrically insulating overcoating of the photoreceptor, while the photoconductive carrier generating layer is uniformly illuminated and grounded. For example, charge removal can be effected by A.C. corona discharge in the presence of illumination from a light source, or preferably a grounded conductive brush could be brought into contact with the surface of the photoreceptor in the presence of such illumination. This latter mode also will remove any residual toner particles remaining on the surface of the photoreceptor.

The invention will now be described in detail with respect to specific preferred embodiments thereof, it being understood that these examples are intended to be illustrative only and the invention is not intended to be limited to the materials, conditions, process parameters and the like recited herein. All parts and percentages are by weight unless otherwise indicated.

EXAMPLE I

A photoresponsive device was prepared by sequentially evaporating several discrete inorganic layers onto a 5 mil abraded and etched aluminum substrate in a standard vacuum coater at a background pressure of $1\text{-}2\times10^{-4}$ Torr, millimeters of Hg.

The aluminum substrate was first heated to 110°-119° C. and while held in this temperature range high purity selenium was deposited thereon, from a stainless steel boat whose temperature was raised from 25°-330° C. over a period of 13 minutes. Upon contact with the heated substrate the condensing selenium vapors immediately formed a trigonal selenium layer of about 3 micron thickness. The substrate temperature was then decreased to 65°-80° C. in preparation for the subsequent depositions.

The transport layer was then formed by depositing onto the trigonal selenium layer, from a crucible, a 60 micron layer of selenium arsenic alloy of the composition 0.33 percent arsenic, 20 parts per million chlorine and 99.6 percent selenium. During this step the substrate temperature was maintained at 65°-70° C., the alloy crucible temperature was increased from about 25° to about 290° C., and the evaporation was completed in 27 minutes.

With the substrate temperature in the range of 66°-67° C., the generator layer was then deposited on top of the transport layer. Pressed pellets of a powdered selenium tellurium alloy, 75 percent selenium, 25 percent tellurium were evaporated over a period of 11 minutes from the crucible whose temperature was increased from 190° to 405° C. A 0.3 micron layer of selenium tellurium alloy resulted. The above three layered structure was then overcoated with an 18 micron layer of Vitel, a polyester resin, (commercially available from Goodyear Chemical Company) by conventional solution spraying techniques.

EXAMPLE II

A photoresponsive device was prepared in essentially the same manner as in Example I with the exception that a cylindrical aluminum tube, approximately $4\frac{5}{8}$ inch diameter × 16 inch long, was used as the substrate, the transport material was comprised of an alloy consisting of 0.12 percent arsenic, 87 parts per million chlorine, and 99.9 percent selenium, the generating layer was 0.6 microns in thickness, and the overcoating layer was a polyurethane material instead of a polyester.

EXAMPLE III

The procedure of Example I was repeated with the exception that the transport layer was comprised of 0.5 percent arsenic, 99.5 percent selenium, and 20 parts per million of chlorine.

EXAMPLE IV

The procedure of Example II was repeated with the exception that the transport layer is comprised of 0.2 percent arsenic, 99.8 percent selenium, and 100 parts per million of chlorine.

EXAMPLE V

The procedure of Example II was repeated with the exception that the transport layer was comprised of 0.33 percent arsenic, 0.6 percent selenium, and 100 parts per million of chlorine.

EXAMPLE VI

The procedure of Example II was repeated with the exception that the transport layer was comprised of 0.4 percent arsenic, 99.6 percent selenium, and 200 parts per million of chlorine.

EXAMPLE VII

The procedure of Example I was repeated with the exception that the generating layer was comprised of a selenium-tellurium alloy, containing 80 percent selenium, and 20 percent tellurium, and had a thickness of 0.6 microns.

When the photoresponsive devices of Examples I, II, III, IV, V, VI and VII were used to form images using the double charging imaging process described in detail hereinbefore (reference FIGS. 2A-2C), there resulted images of good quality and high resolution comparable to images formed with conventional photoreceptors, using known xerographic imaging methods, single charging. The comparisons were based on visual observations.

Although this invention has been described with respect to certain preferred embodiments, it is not intended to be limited thereto, rather those skilled in the art will recognize that variations and modifications may be made therein which are within the spirit of the invention and the scope of the claims.

What is claimed is:

1. An electrophotographic imaging method comprising providing a photoresponsive device comprised of a substrate having a thickness of from about 5 mils to about 100 mils; a layer of hole injecting material capable of injecting holes into a layer on its surface, this layer being comprised of trigonal selenium and ranging in thickness of from about 0.5 microns to about 10 microns; a hole transport layer in operative contact with the hole injecting layer, this layer being comprised of a halogen doped selenium arsenic alloy, wherein the percentage by weight of selenium present is from about 99.5 percent to about 99.9 percent, the percentage by weight of arsenic present is from about 0.1 percent to about 0.5 percent, and the halogen is present in an amount of from 10 parts per million to about 200 parts per million, this layer ranging in thickness of from about 5 microns to about 60 microns; a charge generating layer overcoated on the hole transport layer comprised of an alloy of selenium and tellurium, containing from about 70 percent to about 90 percent by weight of selenium and from about 10 percent to about 30 percent by weight of tellurium, said layer ranging in thickness of from about 0.1 microns to about 5 microns; and a layer of an electrically insulating organic resin overlaying the charge generating layer, said layer having a thickness of from 5 microns to about 25 microns, charging the device with negative electrostatic charges, followed by charging the device with positive electrostatic charges in order to substantially neutralize the negative charges residing on the surface of the device, and exposing the device to an imagewise pattern of electromagnetic radiation to which the charge carrier generating material is responsive whereby there is formed an electrostatic latent image on the photoresponsive surface, and optionally transferring the electrostatic latent image to a permanent substrate subsequent to its development with toner.

2. An electrophotographic imaging method in accordance with claim 1 wherein the substrate is conductive and the halogen is chlorine.

3. An electrophotographic imaging method in accordance with claim 1 wherein the selenium tellurium charge generating layer is comprised of 70 percent to 80 percent selenium and from 20 to 25 percent by weight of tellurium.

4. An electrophotographic imaging method in accordance with claim 1 wherein the insulating organic resin is selected from polyurethanes and polyesters, the halogen material is present in an amount of from 50 parts per million to 100 parts per million and the substrate is aluminum.

* * * * *